US006239512B1

(12) United States Patent
Henderson et al.

(10) Patent No.: US 6,239,512 B1
(45) Date of Patent: May 29, 2001

(54) ELECTRIC WATER HEATER WITH SIMPLIFIED PHASE CONVERSION APPARATUS

(75) Inventors: David L. Henderson, Millbrook; Timothy E. Powell, Tallassee, both of AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/363,156

(22) Filed: Jul. 28, 1999

(51) Int. Cl.[7] ..... H02J 1/10; H02J 3/00

(52) U.S. Cl. ..... 307/43; 307/11; 307/13; 392/451

(58) Field of Search ..... 307/43, 85, 11, 307/12, 13, 18, 29; 392/451

(56) References Cited

U.S. PATENT DOCUMENTS

| | | | |
|---|---|---|---|
| 2,613,343 | 10/1952 | Ober | 318/225 |
| 2,994,849 | 8/1961 | Mussari, Jr. | 339/159 |
| 3,509,356 | 4/1970 | Peebles | 307/42 |
| 3,961,126 | 6/1976 | Maddux | 136/6 |
| 4,053,788 | 10/1977 | Robie | 307/11 |
| 4,131,805 | 12/1978 | Austin et al. | 307/147 |
| 4,547,689 | 10/1985 | Tsuchimoto et al. | 310/71 |
| 4,609,244 | 9/1986 | Buscher et al. | 339/32 M |
| 4,748,355 | 5/1988 | Anderson et al. | 310/71 |
| 4,781,610 | 11/1988 | Mercer | 310/71 |
| 4,937,482 | 6/1990 | Dohogne | 310/71 |
| 5,791,919 | 8/1998 | Brisson et al. | 439/166 |
| 5,886,422 * | 3/1999 | Mills | 307/29 |

* cited by examiner

*Primary Examiner*—Teresa Walberg
*Assistant Examiner*—Thor Campbell
(74) *Attorney, Agent, or Firm*—Konneker & Smith, P.C.

(57) ABSTRACT

An electric water heater is provided with simplified phase conversion apparatus including a terminal structure having replaceable line lug portions which are wired to a single phase row of multi-pin connector sockets by single phase routing circuitry, and to a three phase row of multi-pin connector sockets by three phase routing circuitry. Electrical supply wires from sets of fuse holders connected to multiple thermostat/heating element sets are grouped and connected to associated multi-pin connector plugs. To ready the water heater for single phase operation, the plugs are connected to the single phase row of sockets, and to convert the water heater to three phase operation the plugs are simply disconnected from the single phase sockets and connected to the three phase sockets. In this manner the necessity of individually repositioning all of the fuse holder wires on the terminal structure to change from single to three phase operation, or vice versa, is eliminated.

8 Claims, 4 Drawing Sheets

THREE PHASE ROW
SINGLE PHASE ROW
SOCKET #1
SOCKET #2
SOCKET #3
SOCKET #4
SOCKET #5
SOCKET #6
18
20
22
24
26
28
30
32
34
36
50
16
13

ELECTRIC WATER HEATER WITH SIMPLIFIED PHASE CONVERSION APPARATUS

BACKGROUND OF THE INVENTION

The present invention generally relates to electrical apparatus and, in a preferred embodiment thereof, more particularly relates to an electric water heater which incorporates therein apparatus that substantially simplifies the conversion of the water heater between single phase and three phase operation thereof.

Electric water heaters are typically manufactured for use with either a single or three phase electric power supply, and may normally be later converted from single to three phase operation or vice versa. The manufactured electric water heaters are often shipped to warehouses or other holding areas to await delivery to a purchaser. It is often the case that a purchaser needs an electric water heater having a given heating capacity and, for example, being operable with single phase electrical power. If the warehouse has a water heater with the desired heating capacity but manufactured to be operated with three phase electrical power the water heater must be converted at the warehouse to single phase operation (or converted from single to three phase operation as the case may be) before the water heater is delivered to the purchaser.

Modern electric water heaters are often manufactured with multiple immersion type electrical resistance type heating elements, each having an associated thermostat. The thermostats are typically connected through fuse holders to the load side of a terminal structure via what may be a large number of individual wires. AS an example, for an electric water heater having nine heating elements there would typically be 18 individual wires operatively connected to the load side of the terminal structure. When it becomes necessary to change the water heater from one phase operation to another phase operation it is conventionally necessary to individually relocate most or all of these wires on the terminal structure in accordance with a phase conversion wiring diagram provided with the water heater.

As might be imagined, this is a laborious, time-consuming task that must be carefully performed if the phase-converted water heater is to function properly. This laborious phase conversion task, of course, is not limited to electrical water heaters, but is necessary in a wide variety of other electrical devices that may be rewired to convert the phase of their electrical operation. A need thus exists to provide simplified phase conversion apparatus for an electrical device such as an electric water heater. It is to this need that the present invention is directed.

SUMMARY OF THE INVENTION

In carrying out principles of the present invention, in accordance with a preferred embodiment thereof, electrical apparatus, representatively an electric water heater, is provided with a phase conversion system that substantially simplifies the changeover of the water heater from single to three phase operation and vice versa.

The electrical apparatus includes an electrical structure, representatively electrical heating elements in the water heater, which is operable utilizing either single or three phase electrical power, and a terminal structure having a line side portion operative to selectively receive either single or three phase electrical power from a source thereof, and a load side portion having first and second electrical connectors associated therewith.

Power receiving circuitry is coupled to the electrical structure and has a third electrical connector releasably mateable with either selected one of the first and second electrical connectors. To facilitate phase conversion of the electrical apparatus, routing circuitry is interconnected between the line side portion of the terminal structure and the first and second electrical connectors and is operative, without altering the power receiving circuitry, to (1) route single phase electrical power to the electrical structure, via the power receiving circuitry, when the third electrical connector is operatively mated with the first electrical connector and single phase electrical power is being supplied to the line side portion of the terminal structure, and (2) route three phase electrical power to the electrical structure, via the power receiving circuitry, when the third electrical connector is operatively mated with the second electrical connector and three phase electrical power is being supplied to the line side portion of the terminal structure.

In the illustrated preferred water heater embodiment of the electrical apparatus, the first and second electrical connectors are multi-pin connector sockets, and the third electrical connector is a screw-in multi-pin connector plug which is connected by a series of electrical leads to a fuse apparatus which is operatively coupled to the electrical resistance heating elements through controlling thermostats. By simply disconnecting the connector plug from one of the connector sockets and reconnecting it to the other connector socket, the electrical phase operation of the associated heating elements may be conveniently and quickly changed without the necessity of laboriously relocating each of the fuse apparatus leads on the terminal structure.

According to another feature of the invention, the terminal structure includes a housing on which the first and second electrical connectors are carried, and first, second and third replaceable line lug members removably carried by the housing and interconnected to the first and second electrical connectors by the routing circuitry, each line lug member being configured to removably receive an end portion of an electrical power supply lead. Thus, when a phase conversion entails an increase or reduction In the amperage load in the converted system, the same terminal structure may be utilized by simply replacing its line lugs with other line lugs sized to accommodate the differently sized electrical power supply leads required.

DETAILED DESCRIPTION

Figure 1:
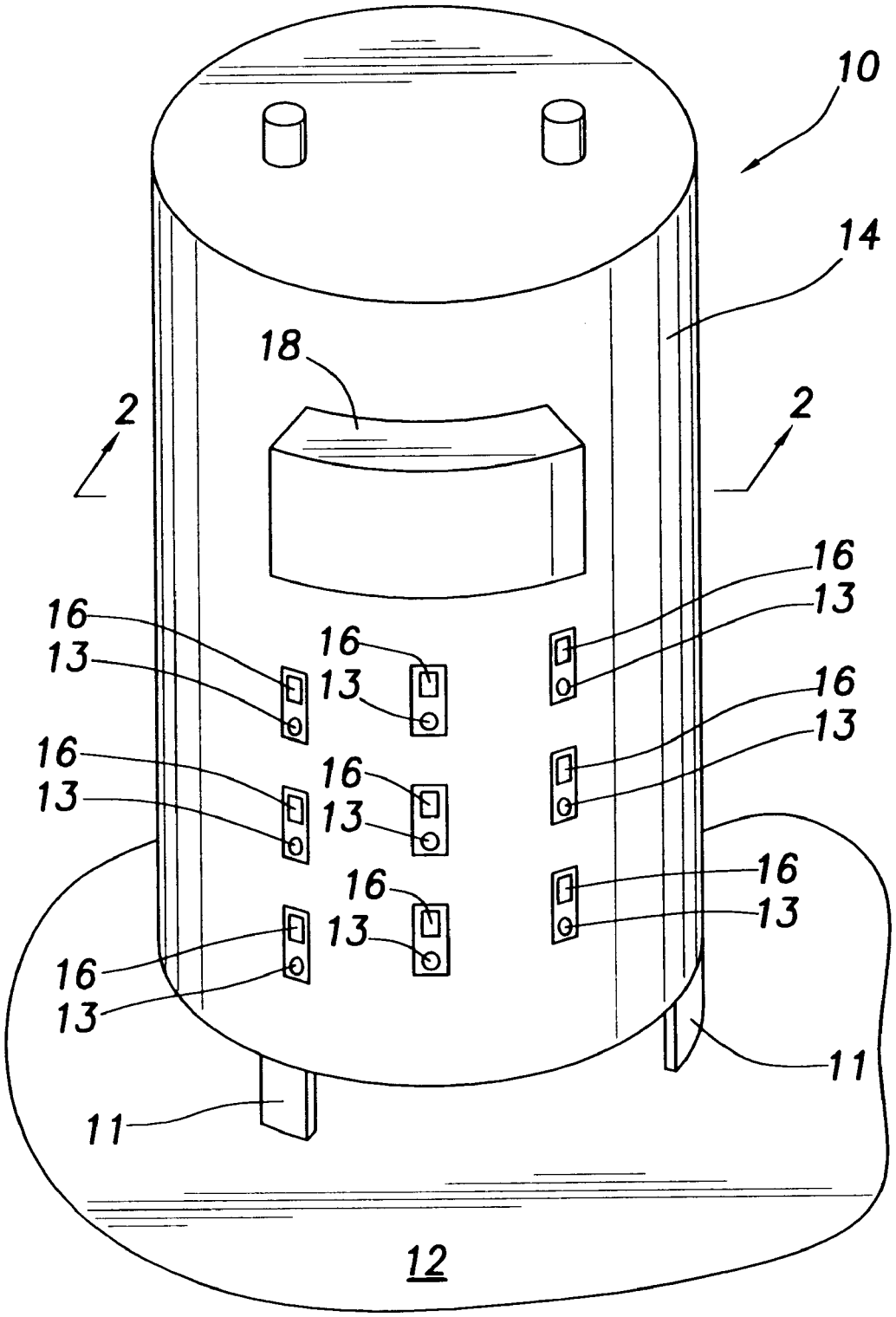
FIG. 1 is a simplified perspective view of a representative electric water heater having incorporated therein simplified phase conversion apparatus embodying principles of the present invention.

Perspectively illustrated in FIG. 1 is an electric water heater 10 that is supported by bottom legs 11 on a floor 12 and representatively has nine electric resistance type immersion heating elements 13 extending into the water-storing interior of an insulated tank portion 14 of the water heater. Each of the nine heating elements 13 is controlled by an associated thermostat 16. Mounted on an upper external portion of the tank 14 is an electrical control box 18, the interior of which is schematically depicted in FIG. 2.

Figure 2:
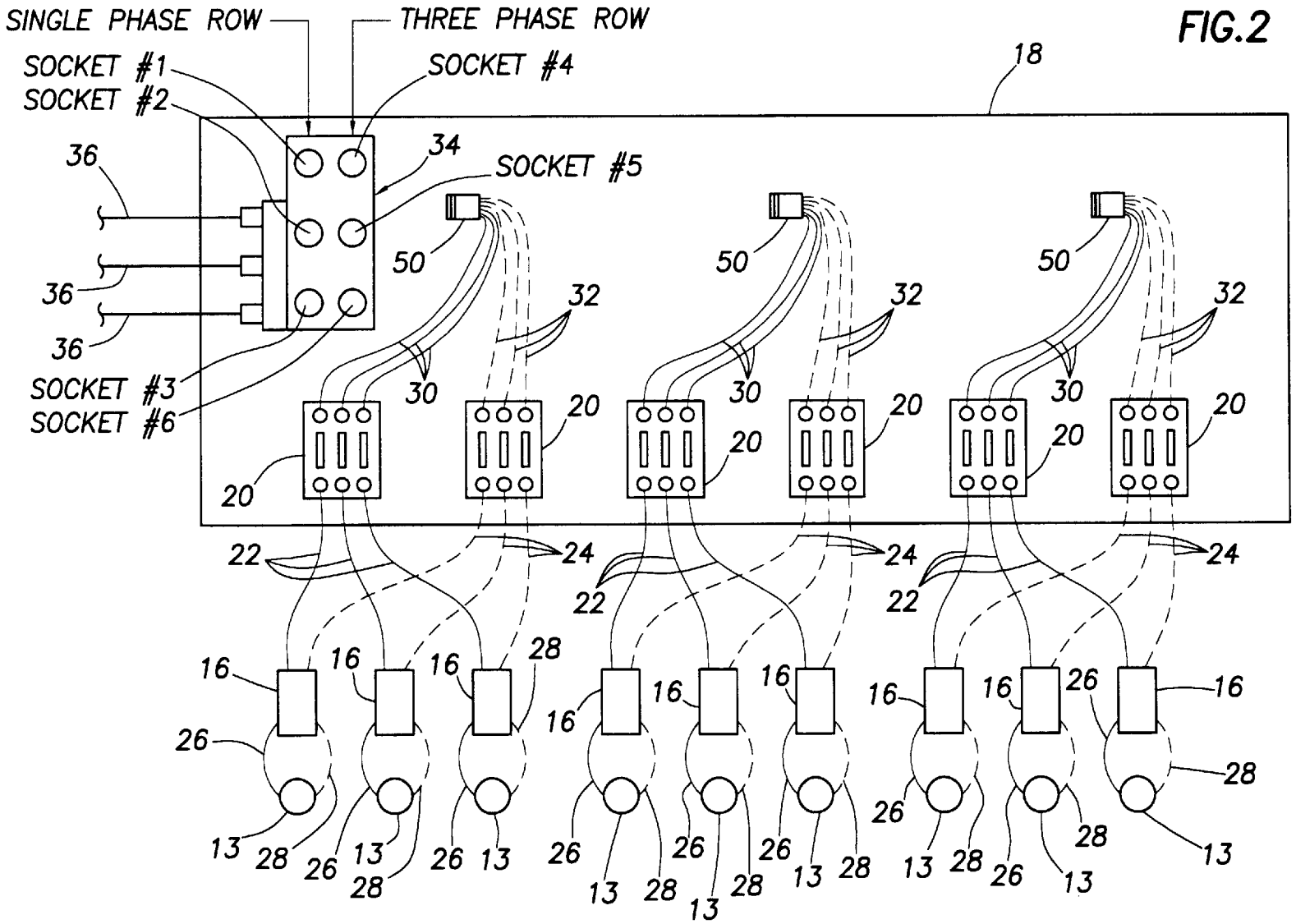
FIG. 2 is an enlarged scale schematic cross-sectional view through an electrical control box portion of the water heater taken along line 2—2 of FIG. 1 and illustrating a load side portion of the electrical phase conversion circuitry.

AS illustrated in FIG. 2, disposed within the electric control box 18 are three pairs of conventional fuse holders 20, with bottom sides of each pair of fuse holders 20 being wired to a set of three of the nine thermostats 16 by the indicated solid and dashed line electrical leads 22,24 (the solid line load side leads shown in FIG. 2 representatively being black, and the dashed line load side leads shown in FIG. 2 representatively being red). Each of the thermostats 16 is wired to an associated electrical heating element 13 by leads 26,28. As illustrated, the top side of one fuse holder 20 in each associated pair thereof has three black electrical leads 30 connected thereto, and the top side of the other fuse holder 20 in each associated pair thereof has three red electrical leads 32 connected thereto.

Also located within the electric control box 18 is a terminal structure 34 having a line side to which electrical power supply leads 36 are connected. The water heater 10 may be operated with either a single phase or a three phase electrical power supply, the system being representatively illustrated in FIG. 2 as being a three phase system, with three leads 36 being connected to the power or line side Of the terminal structure 34. Only two of these leads 36 would be used if the system was being operated with a single phase electrical power supply.

In an electric water heater with a conventional electrical supply system for its thermostats 16 and heating elements 13, each of the leads 30,32 from the top side of the fuse holders 20 would be individually connected to different wiring connection areas on the load side of the terminal structure 34. Accordingly, to convert the system between single and three phase operation it would typically be necessary to reposition all eighteen wires 30,32 on the terminal structure 34 according to a wiring diagram provided with the water heater 10. AS can be readily imagined, this can be a laborious task that must be carefully performed.

Figure 4:
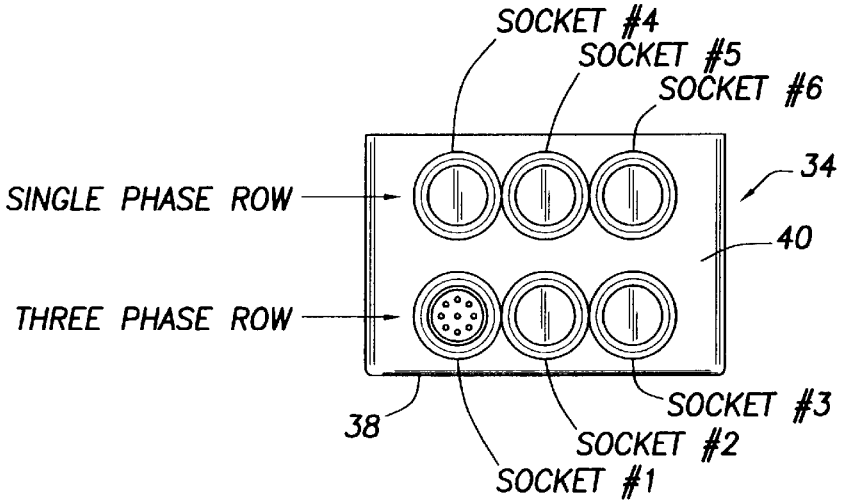
FIG. 4 is a top plan view of the terminal block portion.
Figure 3:
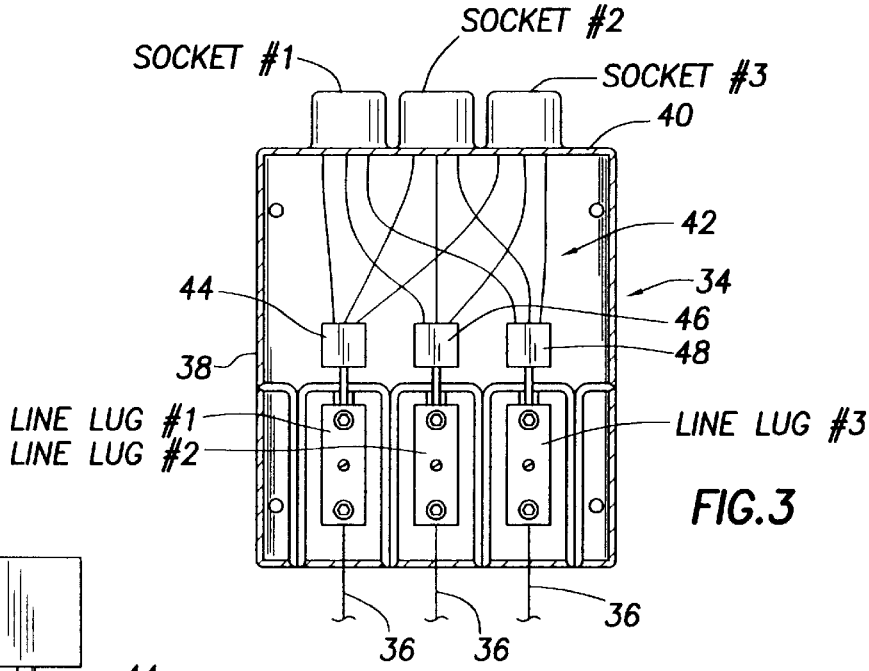
FIG. 3 is an enlarged scale simplified cross-sectional view through a terminal structure portion of the phase conversion apparatus.

In the present invention this conversion between single phase and three phase operation (and vice versa) may be achieved much more quickly and easily by virtue of a special design of the terminal structure 34 and a grouping of the top side fuse holder leads 30 and 32. Referring now to FIGS. 3 and 4, the terminal structure 34 has a housing portion 38 with a top side 40 on which a single phase row of three multi-pin connector sockets #1–#3, and a three phase row of three multi-pin connector sockets #4–#6 are disposed. Sockets #1–#6 are interconnected, by fixed routing wiring 42 within the housing 38, to three multi-tap terminals 44, 46 and 48 which are removably connected to line lugs #1–#3 to which the power supply leads 36 are connected. In FIG. 3, the routing wiring 42 is shown in simplified, highly schematic form, and will be later described herein in greater detail. In a manner subsequently described herein, the line lugs #1–#3 are removably secured to the housing 38 and may be replaced with other lugs sized to receive and be connected to smaller or larger diameter supply leads.

Figure 6:
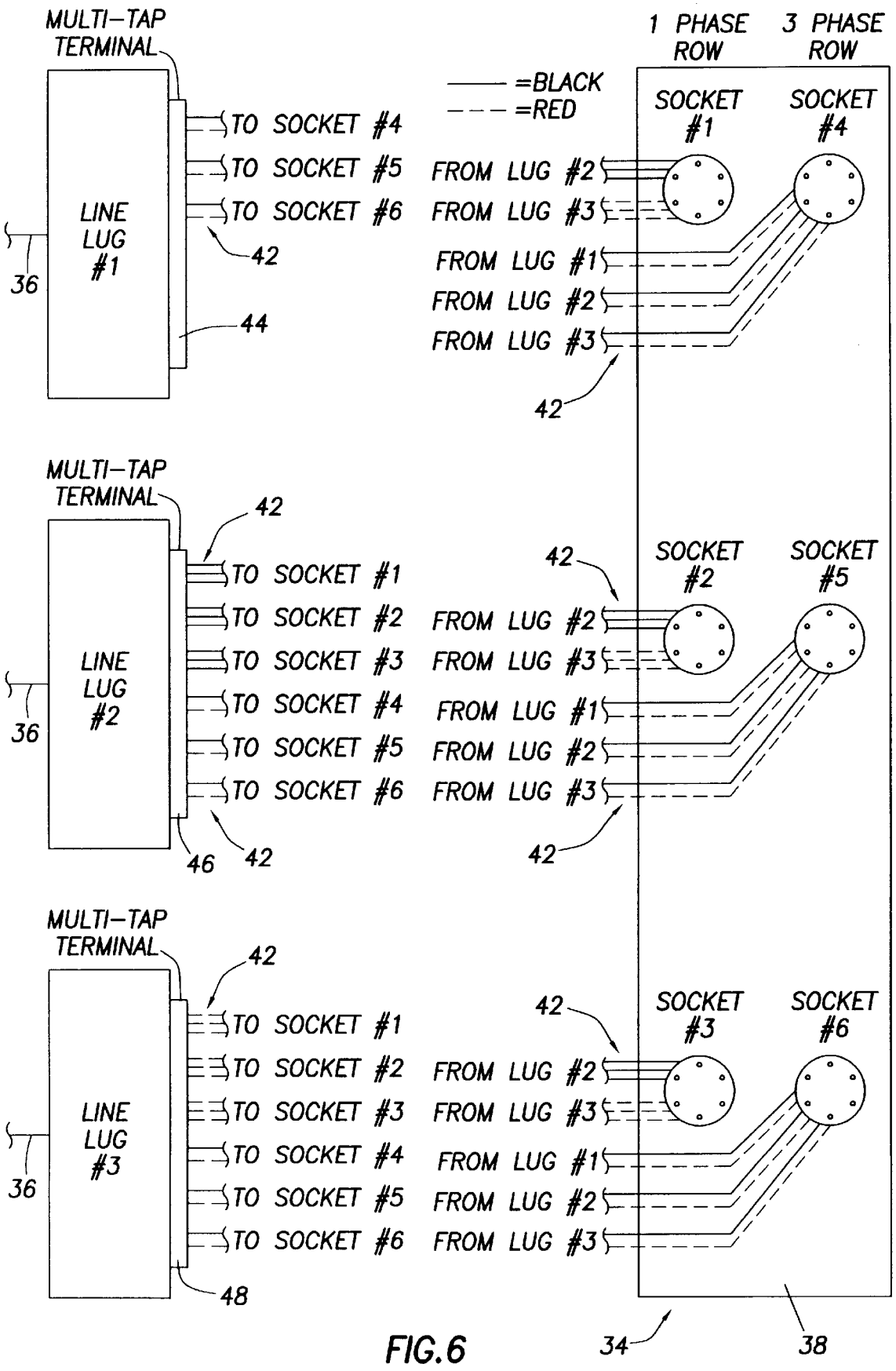
FIG. 6 is a schematic wiring diagram of electrical routing circuitry disposed within the terminal structure portion of the phase conversion apparatus.

The routing wiring 42 is schematically depicted in greater detail in FIG. 6 and, as illustrated, comprises a single phase portion interconnected between the multi-tap terminals 44,46 and 48 and the single phase row of sockets #1–#3, and a three phase portion interconnected between the multi-tap terminals 44,46 and 48 and the three phase row of sockets #4–#6. In FIG. 6, the solid line leads are representatively black, and the dashed line leads are representatively red.

Returning now to FIG. 2, the top side fuse holder leads 30,32 from each associated pair of fuse holders 20 are ganged in a wiring harness arrangement and operatively coupled to a screw-in multi-pin connector 50 which, in turn, may be releasably coupled to one of the terminal structure multi-pin sockets #1–#6.

Thus, when the system is to be operated using a three phase electrical power supply, the plugs 50 are simply screwed into the three phase sockets #3–#6. Alternatively, the screw-in plugs 50 may be other types of multi-pin connectors such as plug-in multi-pin connectors. If it is necessary to convert the water heater 10 to a single phase electrical power supply, all that is required is to unscrew the three plugs 50 from the three phase sockets #4–#6 and screw them into the single phase sockets #1–#3. In this manner, the previous necessity of individually repositioning all of the top side fuse holder wires 30,32 on the terminal structure 34 when it is desired to switch from single phase power supply to three phase power supply (or vice versa) is advantageously eliminated.

If only three heating elements 12 are used in the water heater 10, only one of the plugs 50 needs to be relocated, and if only six heating elements 12 are used only two of the plugs 50 need to be relocated.

Figure 5:
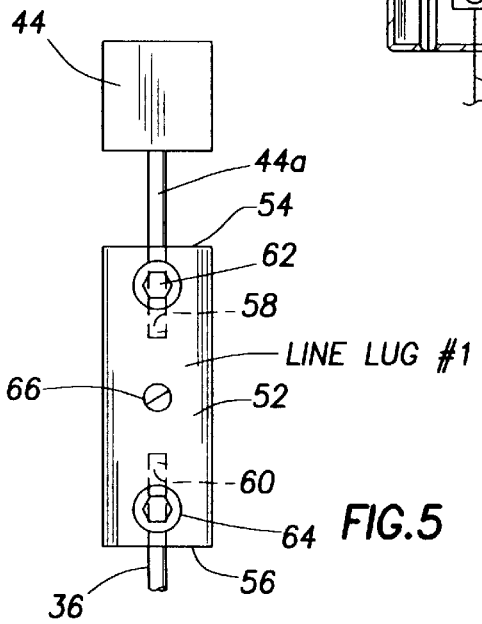
FIG. 5 is an enlarged scale schematic side elevational view of a specially designed replaceable line lug structure removed from the terminal structure portion.

Turning now to FIGS. 3 and 5, as previously mentioned herein each of the line lugs #1–#3 is removable from the terminal structure housing 38 and may be replaced with a line lug adapted for use with a larger or smaller power supply lead 36. In FIG. 5, line lug #1 has been representatively removed from the housing 38 and is shown schematically at a larger scale for purposes of illustrative clarity. Line lugs #2 and #3 have configurations identical to that of line lug #1.

Line lug #1 has an elongated rectangular body portion 52 with opposite ends 54 and 56. Respectively extending inwardly through these opposite ends 54 and 56 are circularly cross-sectioned openings 58 and 60. End opening 58 is configured to complementarily and removably receive a stem portion 44*a* of the of the associated multi-tap terminal 44, with the stem portion 44*a* being releasably retained within the opening 58 by an Allen head screw 62 threaded into the body 52 and bearing against the stem 44*a*. In a similar manner, an inner end portion of the power supply lead 36 shown in FIG. 5 is removably received in the body end opening 60 and releasably retained therein by an Allen head screw 64 threaded into the body 52 and bearing against the inner end of the power supply lead 36.

The line lug body 52 (like the other line lug bodies) is releasably retained within the terminal structure housing 38 by a retaining screw 66 extended through the line lug body 52 and threaded into the terminal structure housing 38. Accordingly, if it necessary to use larger or smaller power supply leads 36 (to accommodate larger or smaller electrical supply amperages) the line lugs #1–#3 may be simply unscrewed, removed from the housing 38 and replaced with different line lugs. In this manner, the same terminal structure 34 may be used for all voltage/phase combinations with which the water heater is designed to operate.

Although the illustrated electrical power supply phase conversion apparatus is representatively used in conjunction with an electric water heater, it could be utilized in conjunction with a wide variety of other types of electrically powered devices such as air conditioning equipment, electrical motors, etc., if desired and is not limited in any manner to water heaters. Moreover, instead of being defined by flexible electrical leads the previously described routing wiring 42 could alternatively be defined by rigid bus bar circuitry if desired.

The foregoing detailed description is to be clearly understood as being given by way of illustration and example, the spirit and scope of the present invention being limited solely by the appended claims.

What is claimed is:

1. Electrical apparatus comprising:

an electrical structure operable utilizing either single or three phase electrical power;

a terminal structure having a line side portion operative to selectively receive either single or three phase electrical power from a source thereof, and a load side portion having first and second electrical connectors associated therewith;

power receiving circuitry coupled to said electrical structure and having a third electrical connector releasably mateable with either selected one of said first and second electrical connectors; and routing circuitry interconnected between said line side portion of said terminal structure and said first and second electrical connectors and being operative, without altering said power receiving circuitry, to:

(1) route single phase electrical power to said electrical structure, via said power receiving circuitry, when said third electrical connector is operatively mated with said first electrical connector and single phase electrical power is being supplied to said line side portion of said terminal structure, and (2) route three phase electrical power to said electrical structure, via said power receiving circuitry, when said third electrical connector is operatively mated with said second electrical connector and three phase electrical power is being supplied to said line side portion of said terminal structure.

2. The electrical apparatus of claim 1 wherein said electrical apparatus is an electric water heater.

3. The electrical apparatus of claim 2 wherein said electrical structure is a plurality of immersion type electrical resistance heating elements.

4. The electrical apparatus of claim 1 wherein said first, second and third electrical connectors are multi-pin type electrical connectors.

5. The electrical apparatus of claim 4 wherein:

said first and second electrical connectors are connector sockets, and said third electrical connector is a connector plug operatively insertable into either selected one of said first and second electrical connectors.

6. The electrical apparatus of claim 5 wherein said third electrical connector is a screw-in type multi-pin connector plug.

7. The electrical apparatus of claim 1 wherein said terminal structure includes:

a housing on which said first and second electrical connectors are carried, and first, second and third replaceable line lug members removably carried by said housing and interconnected to said first and second electrical connectors by said routing circuitry, each line lug member being configured to removably receive an end portion of an electrical power supply lead.

8. The electrical apparatus of claim 7 wherein each of said line lug members has a multi-tap terminal structure removably secured thereto and electrically coupled to said first and second electrical connectors by a portion of said routing circuitry.

* * * * *

UNITED STATES PATENT AND TRADEMARK OFFICE

CERTIFICATE OF CORRECTION

PATENT NO. : 6,239,512 B1
DATED : May 29, 2001
INVENTOR(S) : Henderson

It is certified that error appears in the above-identified patent and that said Letters Patent is hereby corrected as shown below:

Title page,
Item [12], "Henderson et al." should be -- Henderson --.

In section [54], of the first sheet of the patent, "ELECTRIC WATER HEATER WITH SIMPLIFIED PHASE CONVERSION APPARATUS" should be -- SIMPLIFIED ELECTRICAL PHASE CONVERSION APPARATUS --.

In section [75], of the first sheet of the patent, "David L. Henderson, Millbrook; Timothy E. Powell, Tallassee, both of AL (US)" should be -- David L. Henderson, Millbrook AL (US) --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*